United States Patent [19]

Beier

[11] 4,380,914

[45] Apr. 26, 1983

[54] TWIST KEY HOLDER

[75] Inventor: Hanns W. Beier, Valhalla, N.Y.

[73] Assignee: Magic Novelty Co., Inc., New York, N.Y.

[21] Appl. No.: 204,237

[22] Filed: Nov. 5, 1980

[51] Int. Cl.[3] ..... A47G 29/10

[52] U.S. Cl. ..... 70/456 R

[58] Field of Search ..... 70/456 R, 458, 459; 224/268, 269; 24/3 K

[56] References Cited

U.S. PATENT DOCUMENTS

| | | | |
|---|---|---|---|
| 2,600,563 | 6/1952 | Michnoff | 70/458 |
| 3,481,168 | 12/1969 | Unter | 70/458 |
| 4,166,489 | 9/1979 | Lemelson | 70/456 R |
| 4,306,434 | 12/1981 | Drake | 70/458 |

*Primary Examiner*—Robert L. Wolfe

*Attorney, Agent, or Firm*—Gottlieb, Rackman & Reisman

[57] ABSTRACT

A twist key holder is provided to enable a user to attach or detach a key to a key ring in a simple yet secure manner. The holder, molded from stiff but somewhat pliant plastic material, includes a body which acts as a base and a hook on the base that follows a spiral path. The hook curves around and defines an opening, which via a passageway of varying width, leads to the exterior of the holder. An attaching button, molded initially with the body, can attach a standard key to the holder. The band of a key ring can be pushed through the passageway and into the opening, at the end of the spiral path, thereby connecting the key to the key ring. The key can be removed easily by a twist of the key holder.

6 Claims, 6 Drawing Figures

FIG. 1
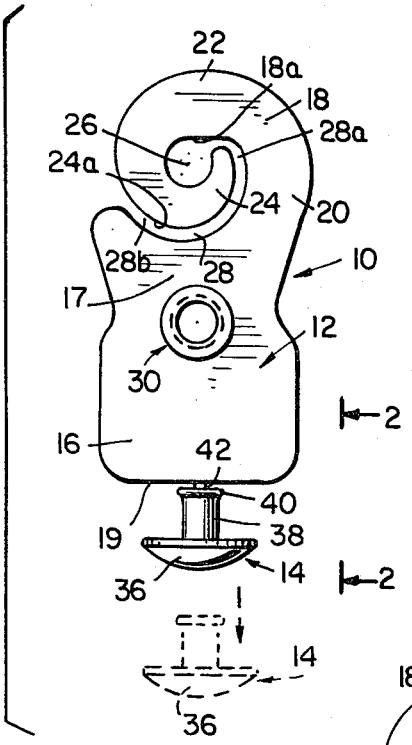
FIG. 2
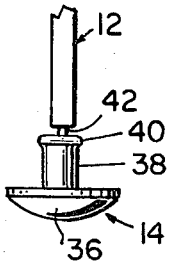
FIG. 3
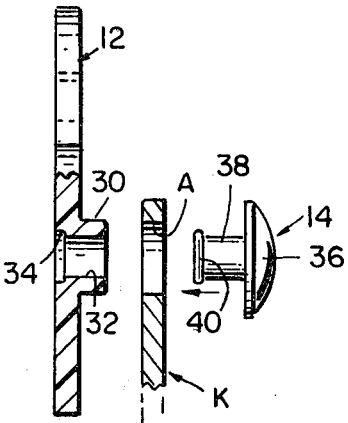
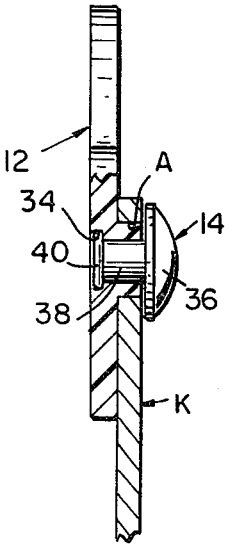
FIG. 4
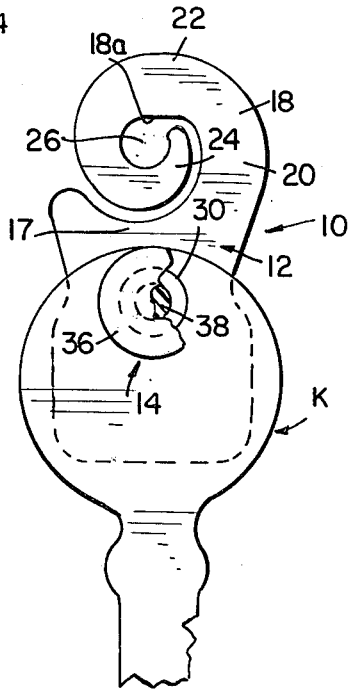
FIG. 5
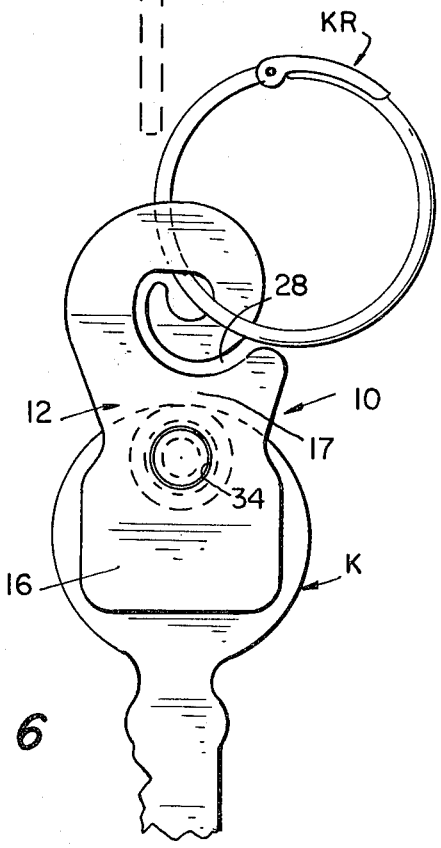
FIG. 6

TWIST KEY HOLDER

This invention relates to a device for enabling a user to attach or detach a key to a key ring in a simple yet secure manner and more specifically relates to a key holder which can readily be connected to a key of standard configuration, and which can then be attached to or be detached from a key ring simply and quickly.

There is a need for a simple, low cost key holder, which can readily attach or detach a key to a key ring in a simple and efficient manner. Quite often, such key holders are utilized in connection with automobile ignition and trunk keys. The automobile driver will often desire to detach the automobile ignition key from a ring of keys, and leave this automobile ignition key, for example with the attendant of a parking lot with his automobile, and desire to retain the remainder of the keys and the key ring with him. For this and similar purposes, a key holder is required which can quickly and easily be attached to a key of standard configuration, and which can be easily attached or detached from a key ring, with required security so that the key holder does not become detached from the key ring accidentally.

In accordance with the present invention, a twist key holder is provided and is molded from a stiff but somewhat pliant plastic material. The holder includes a body which acts as a base and a hook mounted on the base which follows a spiral path. The hook curves around and defines an opening, through which the band of the key ring will pass. The opening is reached by a passageway of varying width, such passageway being narrow adjacent to the opening and being somewhat greater in width as it leads to the exterior of the holder. An attaching button, molded initially with the body, can be easily detached by a user, and is utilized to join a key to the key holder. The button does so by passing through the opening in such key and into a configured bore, which prevents removal of the button. When it is then desired to join the key holder to the band of a key ring, the band is pushed along the passageway until it enters the opening within the hook. Due to the narrowness of the passageway adjacent to the opening, the band of the key ring will not accidentally pass out of the opening. However, when it is desired to remove the key holder from the key ring, the tip of the hook need merely be pushed to the side, enabling the band of the key ring to pass along the passageway to the exterior of the holder, thereby detaching the holder from the ring.

Referring now to the drawings,

FIG. 1 is a front elevational view of the twist key holder, showing the body of the twist key holder and the attaching button; the attaching button being shown in solid lines as connected to said body and the attaching button being shown in dash lines as detached therefrom;

FIG. 2 is a side elevational view of a lower portion of said body and the attaching button, taken substantially along the line 2—2 of FIG. 1;

FIG. 3 is a cross-sectional view of the body of the twist key holder and the attaching button, before their connection to a key;

FIG. 4 is a view similar to FIG. 3, but with the attaching button locked to the body of the twist key holder, with a key held between these members;

FIG. 5 is a front elevational view of the twist key holder, with key connected thereto; and FIG. 6 is a rear elevational view thereof.

Referring now in detail to the drawings, an embodiment of a twist key holder 10 is shown in elevation in FIGS. 1, 5 and 6. The twist key holder 10 can be used with any key K of standard shape having an aperture A formed therein, in the usual location in the head of the key. The twist key holder 10 comprises two components, a holder body 12 and an attaching button 14. The body 12 is formed from any stiff but slightly flexible plastic sheet material, of relatively small thickness, as seen in FIGS. 2, 3 and 4. As examples of the foregoing, the material of the twist key holder 10 may be nylon or polypropylene.

The body 12 includes a lower segment or base 16 which is substantially square in elevation and an upper segment or hook 18, the hook being integral with and being supported by the base. The base 16 has a lower edge 19. The base 16 may be decorated or printed with advertising material.

The hook 18 includes a thickened stem portion 20 which curves along a spiral path to a thinner mid-portion 22 which curves still along a spiral path to a thinner tip portion 24. The stem 20, mid-portion 22, and tip 24 encircle and define a central opening 26. This opening is formed by the inner edge 18*a* of the hook 18.

The opening 26 is connected by a curved narrow passageway 28 to the exterior of the twist key holder. The portion of the passageway 28*a* at the tip 24 is narrower in width than the portion of the passageway 28*b* near the base 16 of the hook 18. The passageway is defined by edge 18*a* of the hook 18 and by the opposed edge 24*a* of tip 24.

Centrally located on the twist key holder 10 is a cylindrical stud 30 which projects from one face of the holder, having a central bore 32 formed therein. The bore has an enlarged mouth 34, the mouth being situated adjacent the face of the twist key holder 10 which is opposed to the face from which the stud 30 projects.

The attaching button 14 includes an enlarged, outwardly convex head 36 and a somewhat elongated stem 38 attached to the head 36, which terminates in an enlarged stem flange 40.

As best seen in FIGS. 1 and 2, when the twist key holder 10 is molded, the attaching button 14 is molded simultaneously, said attaching button 14 being fixed to the lower edge 19 of the body 12 of the twist key holder 10 by a thin runner 42. Of course, while in the embodiment shown in the drawings, the attaching button 14 is located at the bottom edge of the key holder, in fact it may be fixed to the twist key holder body 12 at any desired location.

In the form shown in FIGS. 1 and 2, the unit is packaged and sold to the public. This necessitates less handling and presents a package attractive to the public.

After the twist key holder 10 has been purchased, a user may readily twist off the attaching button 14 from the body 12, and in doing so, will rupture the runner 42.

Next, a key K with an aperture A is placed so that the aperture A fits over the exterior surface of the stud 30, see FIGS. 3 and 4. The length of the stud 30, measured from the face of the body 12 to the outer face of the stud 30, is as long as or somewhat longer than the thickness of the key K. With the key aperture A over the stud, the attaching button 14 is oriented so that the stem flange 40 is pushed into the bore 32, and continuously pushed until the stem flange 40 reaches and enters the stem mouth 34. The flange 40 moves through the bore 32 under moderate pressure, since there is a friction fit therebetween. When the stem flange 40 reaches the mouth 34, it nests nicely there, and it is difficult to subsequently withdraw the attaching button 14 from the stud 30. The diameter of the stud 30 will desirably be less than the diameter of the key aperture, to permit the key to rotate or swing with respect to the holder.

After the key K has been in this manner connected to the twist key holder, the holder may be connected or "twisted" onto a key ring KR, FIG. 6. To this end, the band of the ring is moved through the passageway 28, from the wider portion **28*b* thereof to the narrower portion 28*a* thereof. Depending upon the diameter of the band of the key ring, the band will frictionally engage the opposing faces 24*a*, 18*a* of the passageway 28** at some point.

The tip 24 of the hook 18 can be flexed slightly to the side by the key ring, to permit continuous passage and entry of the key ring from the passageway 28 into the opening 26. As mentioned previously, since the opening **28*a* is quite narrow near the opening 26**, the key ring band will enter the opening only with the application of slight force.

Once the band of the key ring is within the opening 26, the twist key holder carried out its proper function of attaching a key to the key ring.

Since the passageway 28 at its narrowest portion **28*a* is of smaller dimension than the diameter of the band of the key ring, the band will not accidentally leave the opening 26 and enter the passageway 28. However, when it is desired to remove or detach the twist key holder from the band of the key ring, this can be accomplished quickly and simply. To this end, the tip 24 of the hook 18 is twisted to one side, enabling movement of the band of the key ring out of the opening and into the narrow portion 28*a* of the passageway 28 and then along the remainder of the passageway. The foregoing twisting action applied to the tip 24** can be accomplished for example by simply forcing the band of the key ring against such tip, thereby moving such tip slightly out of the plane of the body of the twist key holder.

There has thus been described a desired embodiment of a twist key holder to which can readily be connected by means of an attaching button, a key of standard configuration. Once such key is connected to the twist key holder, the holder itself can be easily and quickly attached to the band of a key ring. The removal of the twist key holder from the band of the key ring requires a twisting force to be applied to the tip of the hook of the twist key holder, this providing security against accidental removal of the twist key holder from the key ring.

There is claimed:

1. A twist key holder for removably coupling a key to a ring, said twist key holder including:

a twist key body, a hook formed of a stiff but pliant material attached to the body, the hook including a stem portion, a mid-portion and a tip portion which follow a spiraling path terminating in the tip portion, the stem, the mid-portion and the tip encircling to define a generally circular opening, the tip portion terminating in close spaced relation to the mid-portion, the tip portion being adapted for twisting and flexing movement out of the plane of the hook, a passageway of narrowing width formed in the hook, said passageway leading into the opening, said passageway being relatively wide adjacent the exterior of the twist key holder for receiving the key ring and narrow adjacent the opening to block passage of the key ring from within the opening, the tip flexing out of the plane of the hook by application of a sideways force to permit passage and entry of the key ring through the passageway into the opening, the tip flexing into the plane of hook upon entry of the key ring in the opening to lock the key ring in engagement with the twist key holder while enabling ready disengagement of the key ring by flexing the tip for passage of the key ring to the exterior of the key holder, an attaching button including an enlarged head, a stem attached to the head, and an enlarged flange at the end of the stem, and means for attaching the button to the body, said means including a stud configured to accept the attaching button, the stud being shaped to pass through the aperture of a key of standard configuration.

2. A twist holder as set forth in claim 1 wherein said twist key body includes a base integral with the hook and wherein the hook includes an inner edge which defines the opening.

3. A twist key holder as set forth in claim 2 wherein the tip portion of the hook includes an edge situated in opposing relation to the inner edge of the hook, and wherein said passageway is defined by the inner edge of the hook and the opposing edge of said tip.

4. A twist key holder as set forth in claim 3 wherein the hook is formed from stiff but pliant plastic material.

5. A twist key holder as set forth in claim 1 wherein the attaching button is molded in one piece with the remainder of the twist key holder, and is connected thereto by a rupturable runner.

6. A twist key holder as set forth in claim 3 wherein the base of the body is substantially square and is imprinted.

* * * * *